US011722810B2

(12) United States Patent
Chang

(10) Patent No.: US 11,722,810 B2
(45) **Date of Patent: *Aug. 8, 2023**

(54) WIRELESS EARPHONES

(71) Applicant: NANJING SILERGY MICRO (HK) CO., LIMITED, Causeway Bay (HK)

(72) Inventor: Chia-Lin Chang, Taipei (TW)

(73) Assignee: NANJING SILERGY MICRO (HK) CO., LIMITED, Causeway Bay (HK)

( * ) Notice: Subject to any disclaimer, the term of this patent is extended or adjusted under 35 U.S.C. 154(b) by 49 days.

This patent is subject to a terminal disclaimer.

(21) Appl. No.: 17/477,580

(22) Filed: Sep. 17, 2021

(65) Prior Publication Data

US 2022/0103925 A1 Mar. 31, 2022

(30) Foreign Application Priority Data

Sep. 30, 2020 (CN) ..... 202011061049.X

(51) Int. Cl.
*H04R 1/10* (2006.01)
*H01Q 1/27* (2006.01)

(52) U.S. Cl.
CPC ..... *H04R 1/1041* (2013.01); *H01Q 1/273* (2013.01); *H04R 2420/07* (2013.01)

(58) Field of Classification Search
CPC ..... H04R 1/1041; H01Q 1/273
See application file for complete search history.

(56) References Cited

U.S. PATENT DOCUMENTS 9,525,761 B1 * 12/2016 Chang ..... H04M 1/0202
2011/0012793 A1 * 1/2011 Amm ..... H01Q 1/44 343/702
2012/0154245 A1 * 6/2012 Nagumo ..... H01Q 1/243 343/861
2013/0241796 A1 * 9/2013 Nagumo ..... H04B 1/0458 343/861
2014/0315592 A1 * 10/2014 Schlub ..... H04W 52/367 455/522
2016/0061983 A1 * 3/2016 Heikura ..... H01Q 1/243 324/207.15

* cited by examiner

*Primary Examiner* — Simon King
(74) *Attorney, Agent, or Firm* — Amin, Turocy & Watson, LLP

(57) ABSTRACT

A wireless earphones comprising a plurality of antenna modules, a radio frequency module, a sensing module, a speaker module and a processing module. The plurality of antenna modules are coupled to each other. The radio frequency module is used to receive or transmit radio frequency signals by the antenna modules. The sensing module is used to sense a capacitance value of a parasitic capacitance of the antenna modules and used to generate a corresponding sensing signal. The speaker module is used to play audio signals. The processing module is used to generate a control signal according to the radio frequency signal or the sensing signal to control the speaker module to play the audio signal corresponding to the control signal.

15 Claims, 7 Drawing Sheets

WIRELESS EARPHONES

RELATED APPLICATIONS

The present application claims the priority of Chinese Application No. 202011061049.X, filed Sep. 30, 2020, the disclosure of which is hereby incorporated by reference herein in its entirety.

BACKGROUND OF THE INVENTION

1. Field of the Invention

The present disclosure generally relates to a wireless earphones, and, more particularly, to a wireless earphones capable of receiving user operation instructions.

2. Description of the Related Art

In general, true wireless stereo (TWS) earphones comprises components such as a processor, antenna, and radio frequency circuit. These components are usually disposed on a printed circuit board (PCB). In addition, some control components will be disposed in the earphones body in order to facilitate the operation. The control components are used to receive user's operation instructions through mechanical contact, acceleration sensing or capacitance sensing, and these control components must also be disposed on the PCB. In the prior art, the control components are accommodated in the TWS earphones by increasing the area or number of the PCB. However, this will increase the size, weight and manufacturing cost of the TWS earphones.

In addition to the above problems, taking the control component using capacitance sensing as an example, a contact interface part of the control component must be disposed outwardly on the earphones in order to receive the user's operation instructions. Therefore, the antenna component must be disposed on the inner side of the earphones (that is, toward the user's head). This will make the ability of the antenna component to receive or transmit radio frequency signals worse. Moreover, the radio frequency signal transmitted by the antenna component may affect the health of the user. Therefore, how to provide a wireless earphones that can integrate receiving or transmitting radio frequency signal and sensing functions has become an urgent problem to be solved in the industry.

SUMMARY OF THE INVENTION

In light of solving the foregoing problems of the prior art, the present invention provides a wireless earphones comprising a plurality of antenna modules, a radio frequency module, a sensing module, a speaker module and a processing module. The plurality of antenna modules are coupled to each other. The radio frequency module is coupled with the antenna modules. The radio frequency module is used to receive or transmit radio frequency signals by the antenna modules. The sensing module is coupled with the antenna modules. The sensing module is used to sense a capacitance value of a parasitic capacitance of the antenna modules and used to generate a corresponding sensing signal. The speaker module is used to play audio signals. The processing module is connected with the radio frequency module, the sensing module and the speaker module. The processing module is used to generate a control signal according to the radio frequency signal or the sensing signal to control the speaker module to play the audio signal corresponding to the control signal.

In an embodiment, the plurality of antenna modules are coupled to each other through a first capacitor structure.

In an embodiment, the first capacitor structure is a distributed capacitor structure or a lumped distributed capacitor structure.

In an embodiment, the radio frequency module is coupled with one of the antenna modules through a second capacitor structure.

In an embodiment, the second capacitor structure is a distributed capacitor structure or a lumped distributed capacitor structure.

In an embodiment, the sensing module is coupled with the antenna modules through a first inductor.

In an embodiment, the processing module is further used to determine the distance between an object and the antenna module or whether the object contacts the antenna module according to the capacitance value measured by the sensing module.

In an embodiment, the wireless earphones comprises a plurality of the sensing modules coupled with corresponding antenna modules respectively, and the processing module is further used to determine the contact between the object and the antenna modules in chronological order.

In an embodiment, the antenna module has a rectangular shape.

In an embodiment, the antenna modules have a total length which is equal to ⅛ to 1 wavelength of the radio frequency signal.

In an embodiment, the antenna modules are disposed on a flexible printed circuit board.

In an embodiment, the wireless earphones further comprises a storage module. The storage module is connected with the processing module, and the storage module is used to store digital information.

In an embodiment, the wireless earphones further comprises a power module. The power module is connected with the processing module, and the power module is used to supply required power to the radio frequency module, the sensing module, the speaker module and the processing module for the operation thereof.

In an embodiment, the wireless earphones further comprises a microphone module. The microphone module is connected with the processing module, and the microphone module is used to convert an external audio signal into a digital audio signal.

In an embodiment, the wireless earphones further comprises an infrared sensing module. The infrared sensing module is connected with the processing module, and the infrared sensing module is used to sense whether the wireless earphones is being worn.

Compared to the prior art, the wireless earphones according to the present invention comprises a plurality of antenna modules, a radio frequency module, a sensing module. The radio frequency module and the sensing module share the antenna modules instead of using different radiators in the prior art. Thus it can save space and cost. In addition, it is not necessary for the antenna modules to be disposed on the inner side of the earphones. The antenna module can fully function and avoid transmitting electromagnetic waves directly to the human body. Moreover, the wireless earphones according to the present invention may also comprise a first capacitor structure, a second capacitor structure or a first inductor to isolate the signals between the components. The wireless earphones may further comprise a storage module, a microphone module or an infrared sensor module to enhance the additional functionality.

BRIEF DESCRIPTION OF THE DRAFLAPS

Figure 3A:
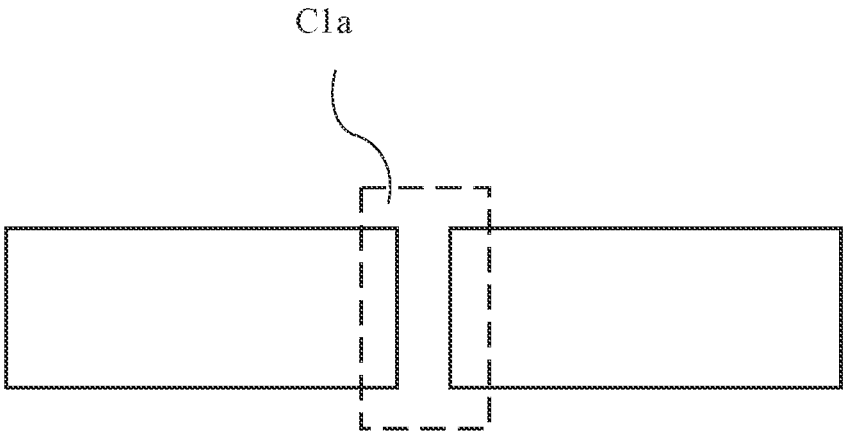
Figure 3B:
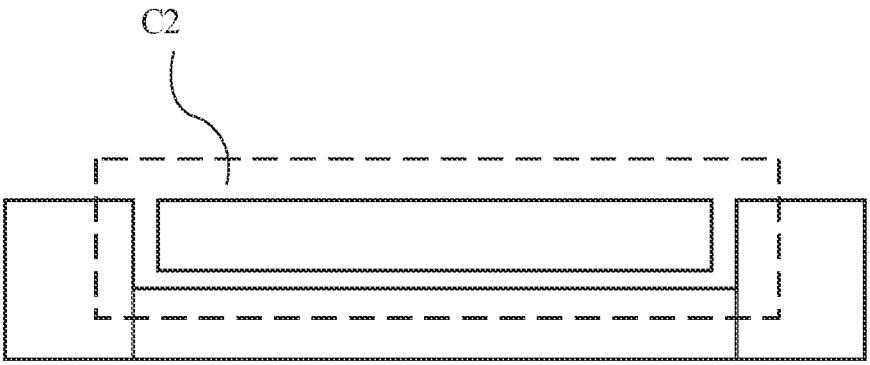

FIGS. 3*a* and 3*b* illustrate schematic views of a structure of the distributed capacitor structure according to a third embodiment of the present invention.

Figure 4:
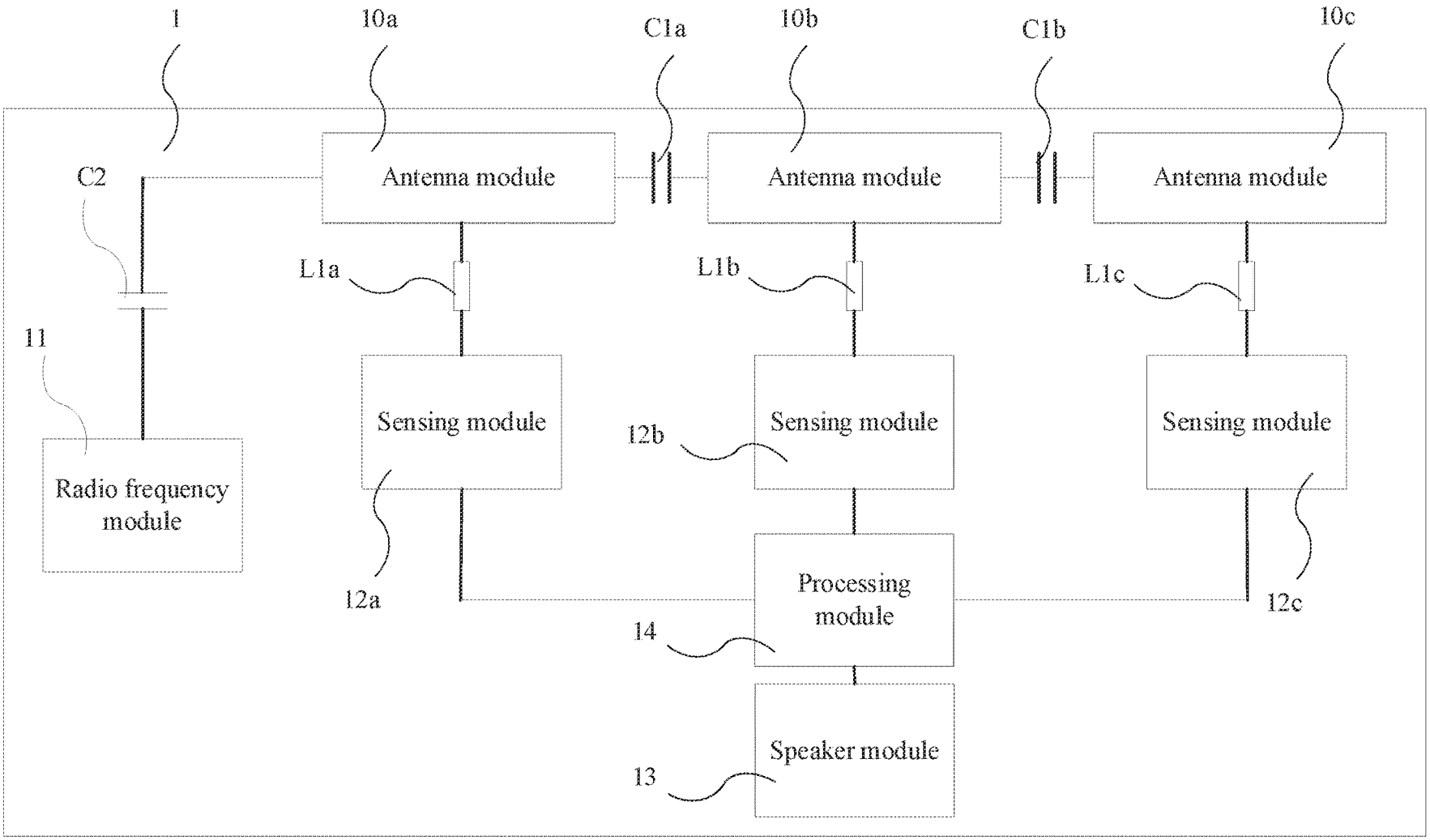

FIG. 4 illustrates a schematic view of a structure of the wireless earphones according to a fourth embodiment of the present invention.

Figure 5:
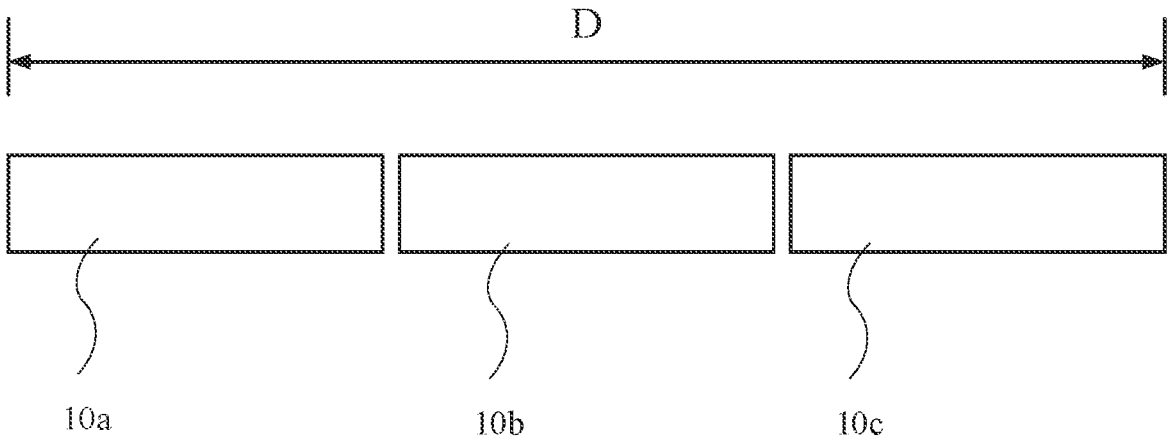

FIG. 5 illustrates a schematic view of a structure of the antenna module according to a fifth embodiment of the present invention.

Figure 6:
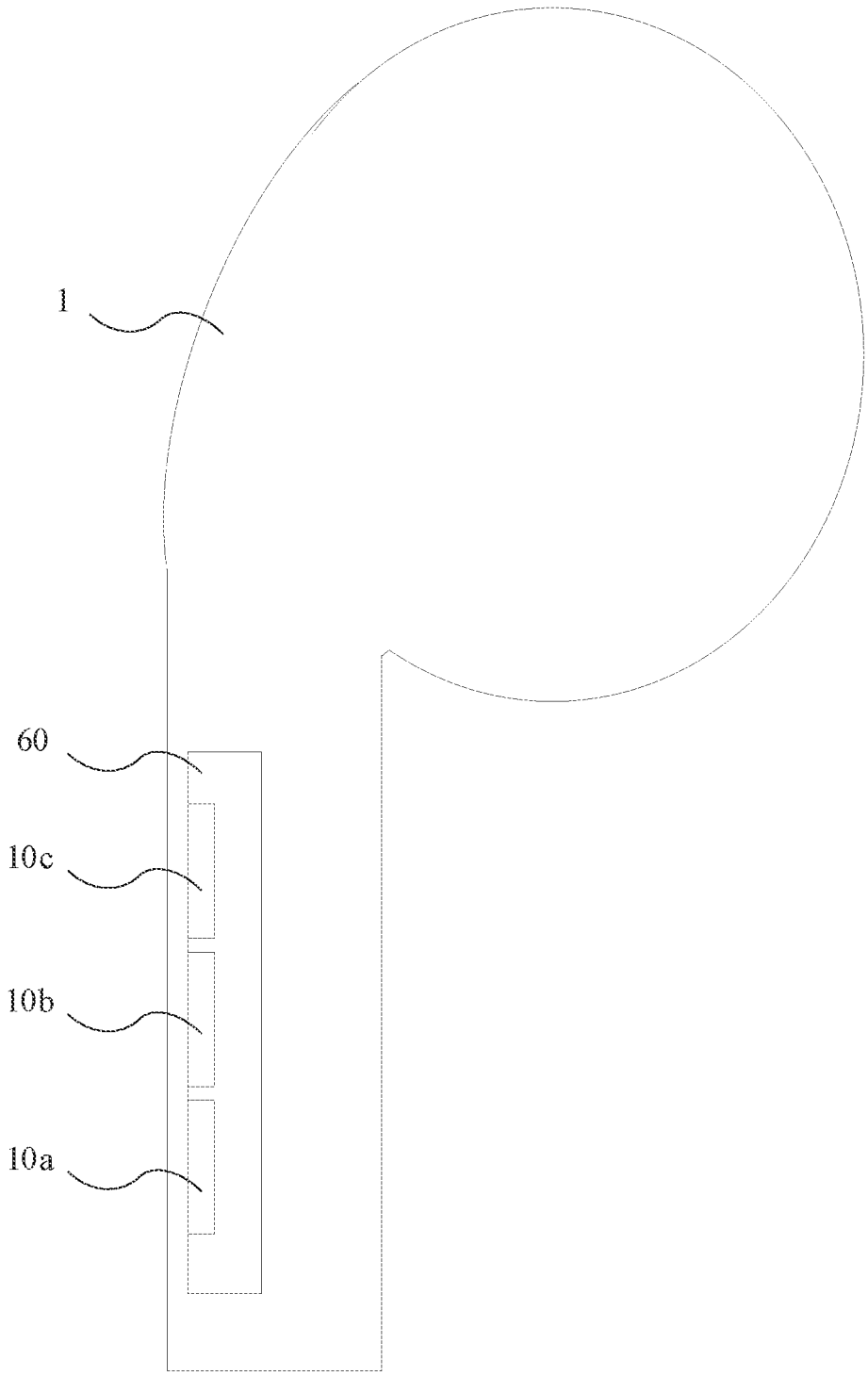

FIG. 6 illustrates a schematic view of a structure of the wireless earphones according to a sixth embodiment of the present invention.

Figure 7:
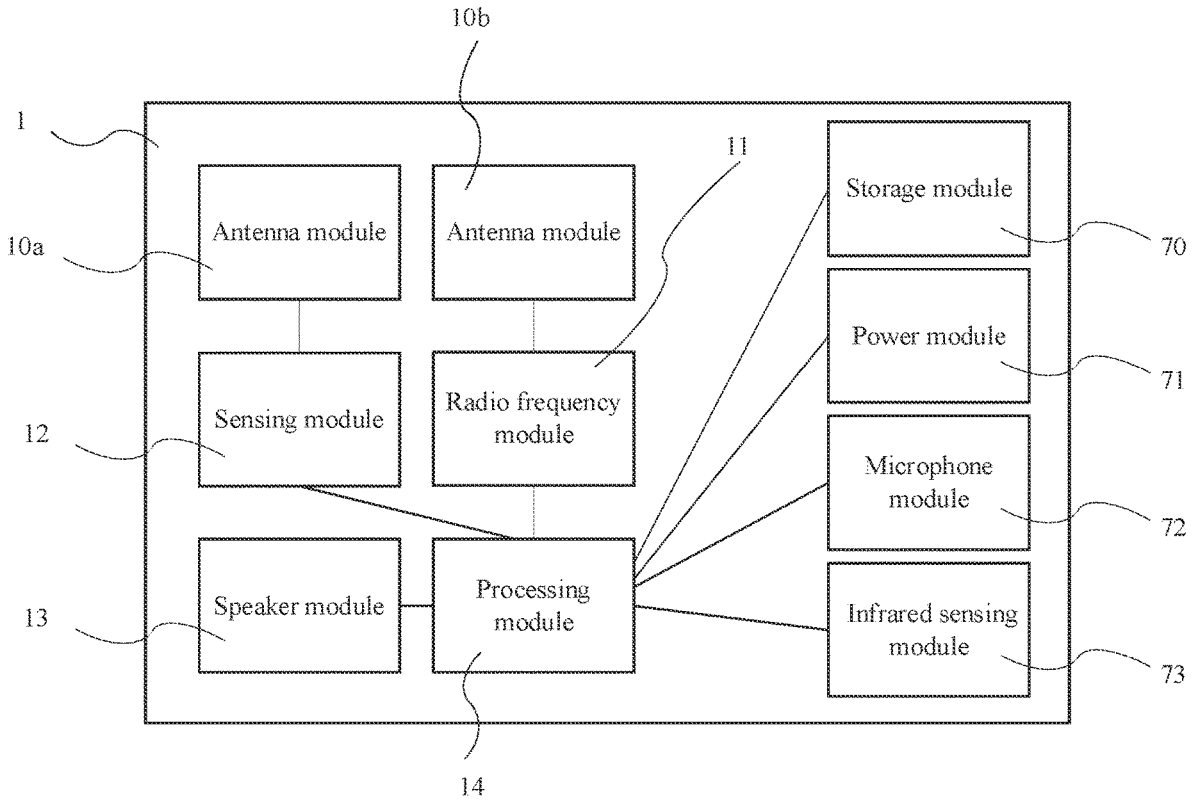

FIG. 7 illustrates a block diagram of the wireless earphones according to a seventh embodiment of the present invention.

DETAILED DESCRIPTION

The present invention is described by the following specific embodiments. Those with ordinary skills in the arts can readily understand other advantages and functions of the present invention after reading the disclosure of this specification. Any changes or adjustments made to their relative relationships, without modifying the substantial technical contents, are also to be construed as within the range implementable by the present invention.

Figure 1:
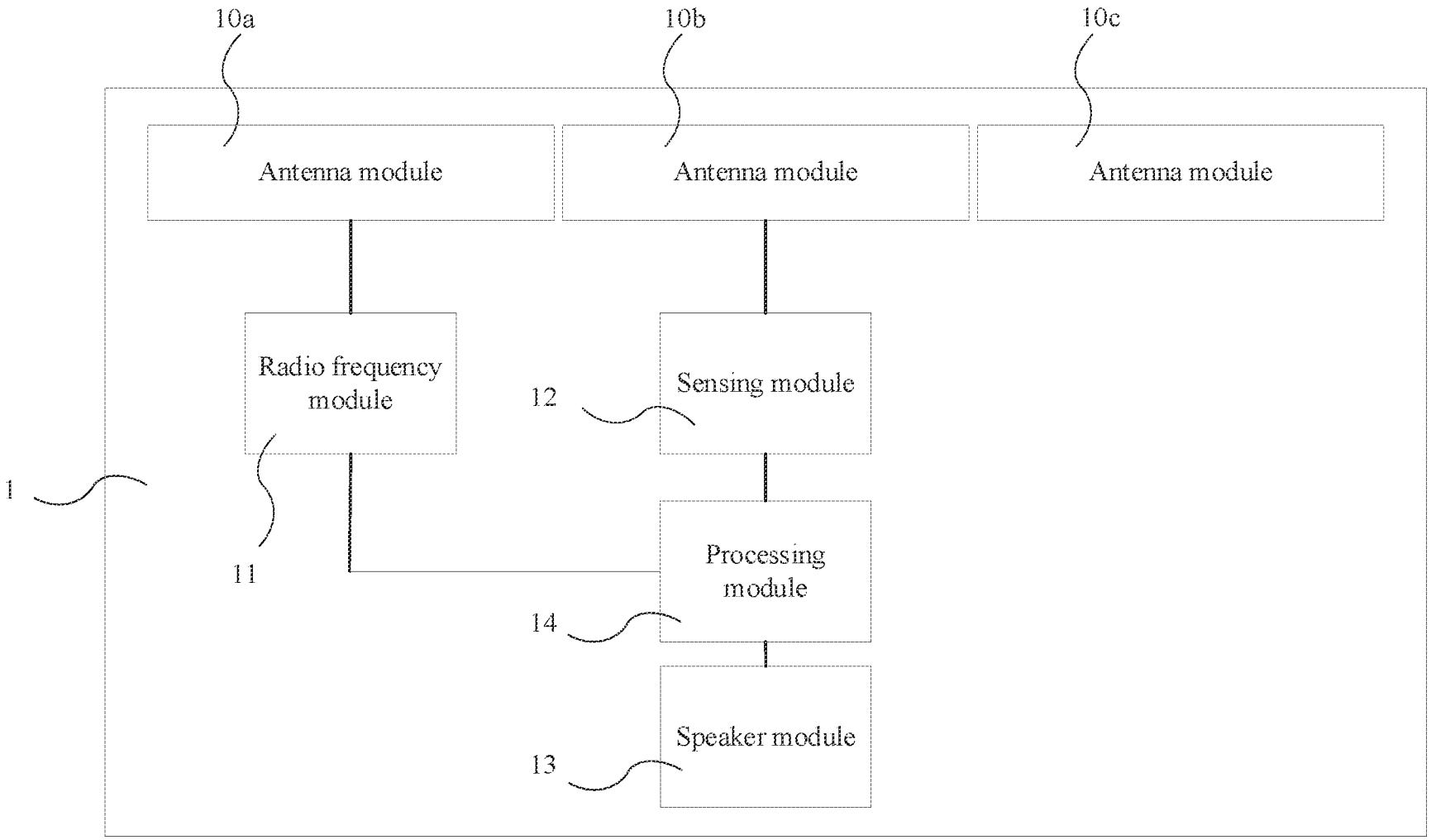
FIG. 1 illustrates a schematic view of a structure of the wireless earphones according to a first embodiment of the present invention.

Please refer to FIG. 1. FIG. 1 illustrates a schematic view of a structure of the wireless earphones according to a first embodiment of the present invention. As shown in the figure, the wireless earphones 1 according to the present invention comprises a plurality of antenna modules 10*a*, 10*b*, and 10*c*, a radio frequency module 11, a sensing module 12, a speaker module 13 and a processing module 14.

The antenna modules 10*a*, 10*b*, and 10*c* are coupled to each other. In this embodiment, the wireless earphones 1 comprises three antenna modules 10*a*, 10*b*, and 10*c*, but not limited to. In other embodiments, the wireless earphones 1 can comprise two or more antenna modules, and these antenna modules are coupled to each other. For example, the distance between adjacent antenna modules 10*a* and 10*b* or the distance between adjacent antenna modules 10*b* and 10*c* is so small that a distributed capacitor structure can be formed therebetween.

The radio frequency module 11 can be coupled with any one of the antenna modules 10*a*, 10*b* and 10*c*. In this embodiment, the radio frequency module 11 is coupled with the antenna module 10*a*, but not limited to. The radio frequency module 11 is used to receive or transmit radio frequency signals by the antenna modules 10*a*, 10*b* and 10*c*. The radio frequency signal is a high frequency signal. Since the antenna modules 10*a*, 10*b* and 10*c* are coupled to each other, all of the antenna modules 10*a*, 10*b* and 10*c* will be used at the same time by the radio frequency module 11 for receiving or transmitting the radio frequency signal. For example, the radio frequency signal can be, but not limited to, electromagnetic wave signals in Wi-Fi frequency band, LTE frequency band or 5G New Radio frequency band under the standards thereof.

The sensing module 12 can be coupled with any one of the antenna modules 10*a*, 10*b* and 10*c*. In this embodiment, the sensing module 12 is coupled with the antenna module 10*b*, but not limited to. The sensing module 12 is used to sense a capacitance value of a parasitic capacitance of the antenna module 10*b* and used to generate a corresponding sensing signal. The sensing module 12 generates the corresponding sensing signal according to a change of the capacitance value. The change of the capacitance value is a low frequency signal. Whether the antenna module 10*b* is touched by an object, such as a part of a human body, or the antenna module 10*b* is approached by an object, such as a part of a human body in a predetermined distance can be determined according to the capacitance value measured by the sensing module 12.

The speaker module 13 is used to play audio signals. The processing module 14 is connected with the radio frequency module 11, the sensing module 12 and the speaker module 13. The processing module 14 is used to generate a control signal according to the radio frequency signal or the sensing signal to control the speaker module 13 to play the audio signal corresponding to the control signal. For example, the radio frequency signal can comprise signals from mobile phones or other devices, such as music, sound, or operating signals. The sensing signal herein can mean a contact of the object, such as a part of a human body, or specific gestures. The processing module 14 can convert the sensing signal into corresponding operation instructions, such as increasing or decreasing the volume of the played audio, or mute. The processing module 14 may be, for example, a processor chip.

Figure 2:
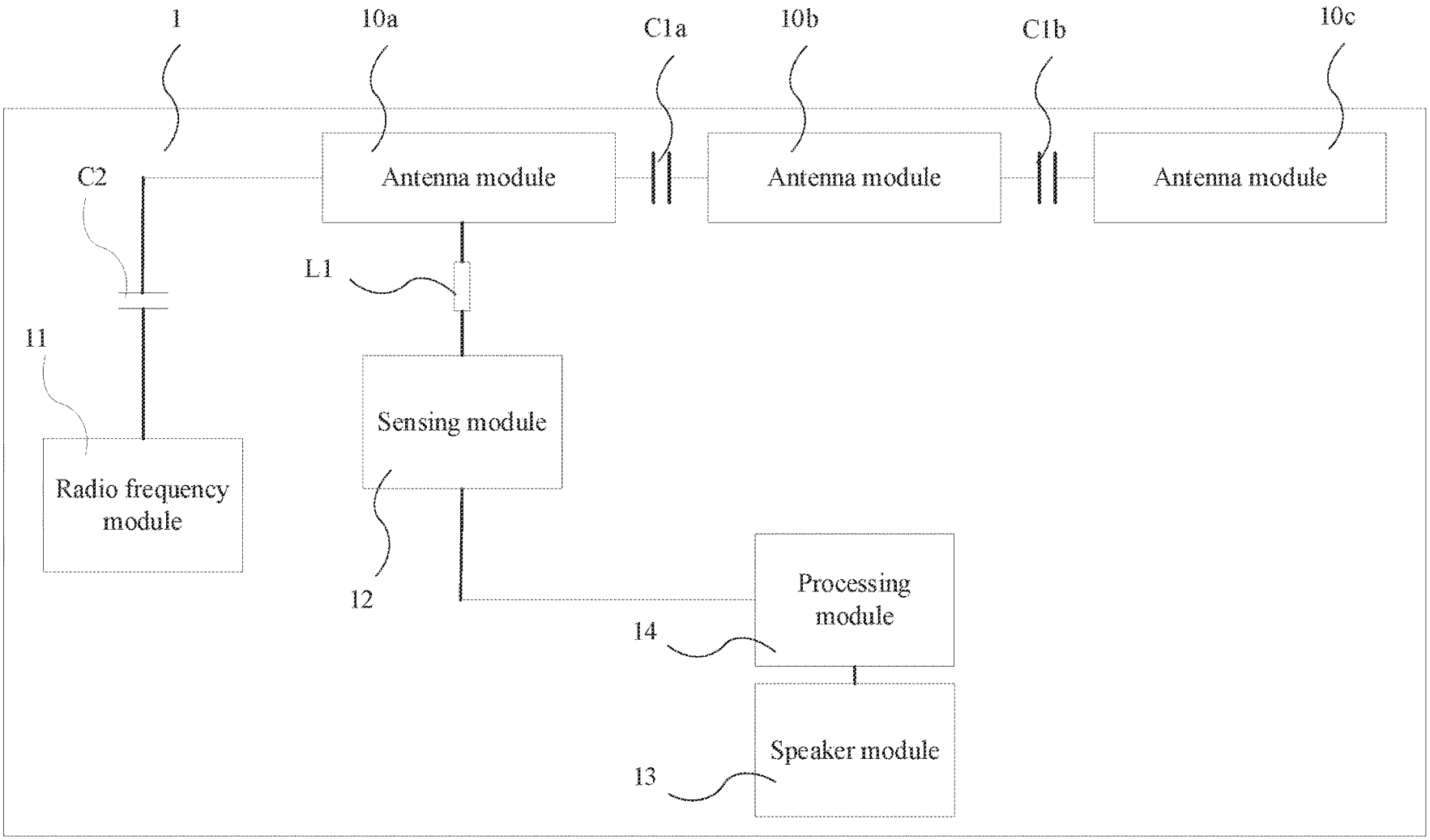
FIG. 2 illustrates a schematic view of a structure of the wireless earphones according to a second embodiment of the present invention.

Please refer to FIG. 2. FIG. 2 illustrates a schematic view of a structure of the wireless earphones according to a second embodiment of the present invention. In an embodiment, the plurality of antenna modules 10*a*, 10*b*, and 10*c* are coupled through a first capacitor structure C1*a* and C1*b*. The first capacitor structure C1*a* and C1*b* can isolate the low frequency signal between the antenna modules 10*a*, 10*b*, and 10*c*. In an embodiment, the first capacitor structure C1*a* and C1*b* can be distributed capacitor structures. For example, the distributed first capacitor structure C1*a* can be formed by reducing the distance between adjacent antenna modules 10*a* and 10*b* and making the shape of the edge of the antenna module 10*a* correspond to the shape of the edge of the antenna module 10*b*.

Please refer to FIGS. 3*a* and 3*b*. FIGS. 3*a* and 3*b* illustrate schematic views of a structure of the distributed capacitor structure according to a third embodiment of the present invention. For example, but not limited to, the distributed capacitor structures can be the structures shown in FIGS. 3*a* and 3*b*.

In another embodiment, the first capacitor structure C1*a*, C1*b* can be a lumped capacitor structure added between the antenna modules 10*a*, 10*b*, and 10*c*. For example, the lumped capacitor structure can be, but not limited to, a multi-layer ceramic capacitor (MLCC).

In an embodiment, the radio frequency module 11 can be coupled with any one of the antenna modules 10*a*, 10*b*, 10*c* through a second capacitor structure C2. In this embodiment, the radio frequency module 11 is coupled with the antenna module 10*a*, but not limited to.

In an embodiment, the second capacitor structure can be a distributed capacitor structure or a lumped distributed capacitor structure. The second capacitor structure C2 can be the same as or different from the capacitor structure as the first capacitor structure Ca, C1*b*.

In an embodiment, the sensing module 12 can be coupled with any one of the antenna modules 10*a*, 10*b*, 10*c* through a first inductor L1. In this embodiment, the sensing module 12 is coupled with the antenna module 10*a*, but not limited to.

The second capacitor structure C2 can isolate the low frequency signals, and the first inductor L1 can isolate the high frequency signals. Therefore, the radio frequency module 11 and the sensing module 12 will not interfere with each other. The radio frequency module 11 and the sensing module 12 can share the antenna modules 10*a*, 10*b*, 10*c* as a radiator, thereby saving cost and component space.

In an embodiment, the processing module 14 is further used to determine the distance between an object (such as a part, e.g. hand, of a human body) and the antenna modules 10*a*, 10*b*, 10*c* or whether the object contacts the antenna modules 10*a*, 10*b*, 10*c* according to the capacitance value measured by the sensing module 12.

Please refer to FIG. 4. FIG. 4 illustrates a schematic view of a structure of the wireless earphones according to a fourth embodiment of the present invention. In an embodiment, the wireless earphones 1 can comprise a plurality of the sensing modules 12*a*, 12*b*, 12*c*. The sensing module 12*a* is coupled with the corresponding antenna module 10*a* through the first inductor L1*a*. The sensing module 12*b* is coupled with the corresponding antenna module 10*b* through the first inductor L1*b*. The sensing module 12*c* is coupled with the corresponding antenna module 10*c* through the first inductor L1*c*. The sensing modules 12*a*, 12*b*, 12*c* are used to sense a capacitance value of a parasitic capacitance of the corresponding antenna module 10*a*, 10*b*, 10*c* respectively. The processing module 14 is further used to determine the contact between the object and the antenna modules 10*a*, 10*b*, 10*c* in chronological order.

In the embodiment of FIG. 4, the number of sensing modules 12*a*, 12*b*, and 12*c* is identical to the number of antenna modules 10*a*, 10*b*, and 10*c*, and both are three. In other embodiments, the number of sensing modules and antenna modules can be adjusted optionally according to the requirements. For example, the wireless earphones according to the present invention could comprise three sensing modules and five antenna modules. The antenna modules that are not coupled with the sensing module can be used as a dummy part to avoid accidental touch.

Furthermore, the sequence or the order of the contacts between the object, such as a part of a human body and the antenna modules 10*a*, 10*b*, 10*c* represents a specific gesture. For example, touching the antenna modules 10*a*, 10*b*, and then 10*c* in sequence represents a first gesture, and touching the antenna modules 10*c*, 10*b*, and then 10*a* in sequence represents a second gesture. The processing module 14 can generate corresponding control signals according to these gestures. In other embodiments, the wireless earphones 1 may comprise more sensing modules or antenna modules to determine more complicated gestures or make the gestures more accurate.

Please refer to FIG. 5. FIG. 5 illustrates a schematic view of a structure of the antenna module according to a fifth embodiment of the present invention. In an embodiment, each of the antenna modules 10*a*, 10*b*, and 10*c* could have a rectangular shape, but not limited to. For example, a ring structure can be divided into several parts, each of which may be as an antenna module.

In an embodiment, the antenna modules 10*a*, 10*b*, and 10*c* may have a total length D which could be equal to ⅛ to 1 wavelength of the radio frequency signal.

Please refer to FIG. 6. FIG. 6 illustrates a schematic view of a structure of the wireless earphones according to a sixth embodiment of the present invention. In an embodiment, the antenna modules 10*a*, 10*b*, and 10*c* can be disposed on a flexible printed circuit board 60. The antenna modules 10*a*, 10*b*, and 10*c* can be disposed on the side of the wireless earphones 1 far away from the human body, so that the direction of transmitting radio frequency signals by the antenna modules 10*a*, 10*b*, and 10*c* does not directly toward the human body. Therefore, the radio frequency signals transmitted by the antenna modules 10*a*, 10*b*, and 10*c* will not be hindered and can avoid endangering the health of the user. The radio frequency module 11, the sensing module 12, and the processing module 14 can also be disposed on the flexible printed circuit board 60, but not limited to. The radio frequency module 11, the sensing module 12, and the processing module 14 can be disposed on another flexible printed circuit board.

FIG. 7 illustrates a block diagram of the wireless earphones according to a seventh embodiment of the present invention. In an embodiment, the wireless earphones 1 can further comprise a storage module 70 in addition to the antenna modules 10*a*, 10*b*, the radio frequency module 11, the sensing module 12, the speaker module 13, and the processing module 14. The storage module 70 is connected with the processing module 14, and the storage module 70 is used to store digital information. For example, the storage module 70 can be, but not limited to, a storage chip.

In an embodiment, the wireless earphones 1 can further comprise a power module 71. The power module 71 is connected with the processing module 14, and the power module 71 is used to supply required power to the radio frequency module 11, the sensing module 12, the speaker module 13, the processing module 14 and other modules for the operation thereof. For example, but not limited to, the power module 71 can be a lithium battery.

In an embodiment, the wireless earphones 1 can further comprise a microphone module 72. The microphone module 72 is connected with the processing module 14, and the microphone module 72 is used to convert an external audio signal into a digital audio signal.

In an embodiment, the wireless earphones 1 can further comprise an infrared sensing module 73. The infrared sensing module 73 is connected with the processing module 14, and the infrared sensing module 73 is used to sense whether the wireless earphones 1 is being worn.

In summary, the wireless earphones according to the present invention comprises a plurality of antenna modules, a radio frequency module, a sensing module. The radio frequency module and the sensing module share the antenna modules instead of using different radiators in the prior art. Thus it can save space and cost. In addition, it is not necessary for the antenna modules to be disposed on the inner side of the earphones. The antenna module can fully function and avoid transmitting electromagnetic waves directly to the human body. Moreover, the wireless earphones according to the present invention may also comprise a first capacitor structure, a second capacitor structure or a first inductor to isolate the signals between the components. The wireless earphones may further comprise a storage module, a microphone module or an infrared sensor module to enhance the additional functionality.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. A wireless earphones, comprising:

a plurality of antenna modules coupled to each other;

a radio frequency module coupled with the antenna modules, and the radio frequency module is used to receive or transmit radio frequency signals by the antenna modules;

a sensing module coupled with the antenna modules, and the sensing module is used to sense a capacitance value of a parasitic capacitance of the antenna modules and used to generate a corresponding sensing signal;

a speaker module used to play audio signals; and a processing module connected with the radio frequency module, the sensing module and the speaker module, wherein the processing module is used to generate a control signal according to the radio frequency signal or the sensing signal to control the speaker module to play the audio signal corresponding to the control signal.

2. The wireless earphones of claim 1, wherein the plurality of antenna modules are coupled to each other through a first capacitor structure.

3. The wireless earphones of claim 2, wherein the first capacitor structure is a distributed capacitor structure or a lumped distributed capacitor structure.

4. The wireless earphones of claim 1, wherein the radio frequency module is coupled with one of the antenna modules through a second capacitor structure.

5. The wireless earphones of claim 4, wherein the second capacitor structure is a distributed capacitor structure or a lumped distributed capacitor structure.

6. The wireless earphones of claim 1, wherein the sensing module is coupled with the antenna modules through a first inductor.

7. The wireless earphones of claim 1, wherein the processing module is further used to determine the distance between an object and the antenna module or whether the object contacts the antenna module according to the capacitance value measured by the sensing module.

8. The wireless earphones of claim 7, wherein the wireless earphones comprises a plurality of the sensing modules, each of which is coupled with the corresponding antenna module respectively, and the processing module is further used to determine the contact between the object and the antenna modules in chronological order.

9. The wireless earphones of claim 1, wherein the antenna module has a rectangular shape.

10. The wireless earphones of claim 9, wherein the antenna modules have a total length which is equal to ⅛ to 1 wavelength of the radio frequency signal.

11. The wireless earphones of claim 1, wherein the antenna modules are disposed on a flexible printed circuit board.

12. The wireless earphones of claim 1, further comprising:

a storage module connected with the processing module, and the storage module is used to store digital information.

13. The wireless earphones of claim 1, further comprising:

a power module connected with the processing module, and the power module is used to supply required power to the radio frequency module, the sensing module, the speaker module and the processing module for the operation thereof.

14. The wireless earphones of claim 1, further comprising:

a microphone module connected with the processing module, and the microphone module is used to convert an external audio signal into a digital audio signal.

15. The wireless earphones of claim 1, further comprising:

an infrared sensing module connected with the processing module, and the infrared sensing module is used to sense whether the wireless earphones is being worn.

* * * * *